US006162780A

United States Patent [19]

Partee et al.

[11] Patent Number: 6,162,780

[45] **Date of Patent: *Dec. 19, 2000**

[54] DETERGENT HAVING IMPROVED COLOR RETENTION PROPERTIES

[75] Inventors: Terrell L. Partee, Scottsdale; Charles Varker, Phoenix; Elaine T. Morse, Mesa; Ronald D. Morgan, Gilbert, all of Ariz.

[73] Assignee: The Dial Corporation, Scottsdale, Ariz.

[ * ] Notice: This patent is subject to a terminal disclaimer.

[21] Appl. No.: 09/370,468

[22] Filed: Aug. 9, 1999

Related U.S. Application Data

[63] Continuation of application No. 08/616,731, Mar. 15, 1996, Pat. No. 5,962,389, which is a continuation-in-part of application No. 08/544,434, Nov. 17, 1995, Pat. No. 5,726,142.

[51] Int. Cl.[7] ..... C11D 3/10; C11D 3/37; C11D 11/00

[52] U.S. Cl. ..... 510/276; 510/302; 510/351; 510/356; 510/361; 510/443; 510/444; 510/452; 510/478; 510/495; 510/497; 510/509

[58] Field of Search ..... 510/276, 302, 510/351, 356, 361, 443, 444, 452, 478, 495, 497, 509

[56] References Cited

U.S. PATENT DOCUMENTS

| | | | |
|---|---|---|---|
| 4,096,081 | 6/1978 | Phenicie et al. | 510/349 |
| 5,108,646 | 4/1992 | Beerse et al. | 510/532 |
| 5,482,642 | 1/1996 | Agar et al. | 510/315 |
| 5,569,645 | 10/1996 | Dinniwell et al. | 510/276 |
| 5,726,142 | 3/1998 | Partee et al. | 510/276 |
| 5,789,365 | 8/1998 | Blokzijl et al. | 510/292 |
| 5,789,366 | 8/1998 | Blokzijl et al. | 510/292 |
| 5,789,367 | 8/1998 | Blokzijl et al. | 510/292 |
| 5,922,663 | 7/1999 | Gabriel et al. | 510/299 |
| 5,962,389 | 10/1999 | Partee et al. | 510/276 |

*Primary Examiner*—Lorna M. Douyon
*Attorney, Agent, or Firm*—Snell & Wilmer LLP

[57] ABSTRACT

A carbonate-based detergent having improved properties is provided. Preferably, a base detergent includes an alkali metal carbonate builder, an anionic surfactant, an inert diluent, a copolymer, and a chlorine scavenger. The base detergent is mixed with an agglomerate including nonionic surfactants and a builder such as an alkali metal carbonate. The detergent has improved color retention properties. A method of preparing the improved detergent composition is also provided.

17 Claims, No Drawings

DETERGENT HAVING IMPROVED COLOR RETENTION PROPERTIES

CROSS REFERENCE TO RELATED APPLICATIONS

This is a continuation application of U.S. Ser. No. 08/616,731 filed Mar. 15, 1996, now U.S. Pat. No. 5,962,389 which is a continuation-in-part application of U.S. Ser. No. 08/544,434 filed Nov. 17, 1995 now U.S. Pat. No. 5,726,142.

TECHNICAL FIELD

The present invention relates, generally, to laundry detergents, and more particularly, to laundry detergents having improved properties.

BACKGROUND OF THE PRESENT INVENTION

Laundry detergents are, of course, well known. As is also well known, in use, such detergents often leave a residue on the items washed in water containing the detergent. In the case of clothing items, this encrustation can result in a loss of softness of the article and the corresponding loss of comfort for the user.

In addition, and as is also well known, the dirty wash liquor and mineral encrustation can, unless inhibited, redeposit on the clothes tending to create unsightly films. After several washes, particularly in the case of colored clothing items, such redeposition can result in fading or other loss of color in such clothing items.

While many attempts have been made to improve laundry detergent antiencrustation and anti-redeposition properties, none have satisfactorily accomplished that objective, particularly in the context of general carbonate-built heavy-duty laundry detergents. The present invention addresses this long felt, yet unresolved need.

SUMMARY OF THE INVENTION.

In accordance with a preferred embodiment of the present invention, a laundry detergent comprises an agglomerated admixture of a base granular formulation, a detergent agglomerate combined in a blending formulation. Preferably, the base granular composition comprises a carrier together with a copolymer. In addition, the detergent includes a chlorine scavenger. This composition has been found to exhibit surprising improvements in the color retention of garments which are washed with such detergents, which improvements are believed to result from improved anti-encrustation, anti-redeposition and chlorine scavenging properties of the detergent.

Preferably, the copolymer comprises an alkali metal salt of a polyacrylic acid, polymethacrylic acid or copolymer of acrylic and methacrylic acids, and evidences a molecular weight preferably in the range of about 2,000 to about 5,000 and more preferably in the range of about 2,000 to about 4,000. Preferably, the chlorine scavenger comprises a reducing agent or other agent such as sodium perborate, sodium percarbonate and/or the like.

In accordance with a further aspect of the present invention, preferably, the base granular composition is spray-dried in a conventional fashion and then admixed with a detergent agglomerate.

DETAILED DESCRIPTION OF PREFERRED EXEMPLARY EMBODIMENTS

Preferred exemplary embodiments of the present invention will hereafter be described in conjunction with the description that follows. It will be understood that the detail provided herein is for illustration purposes only and that the subject invention is not so limited.

While the specific formulations of detergent within the present invention will be described in greater detail hereinbelow, in general, a detergent formulation in accordance with the present invention comprises a base detergent including an alkali metal carbonate and a copolymer, and an agglomerated admix. Preferably, the base detergent and copolymer are spray dried, in a conventional fashion, and thereafter admixed in a blending formulation including the detergent agglomerate and a chlorine scavenger.

Preferably, the base detergent formulation comprises an alkali metal carbonate builder, an anionic surfactant, an inert diluent and a copolymer. The builder (i.g. the alkali metal carbonate) is present in the base bead formulation in an amount from about 30 to about 50 wt % and more preferably from about 34 to about 41 wt %. Suitably, the alkali metal carbonate comprises sodium carbonate. Preferably, the anionic surfactant is present in the base bead formulation in an amount from about 6 to about 15 wt % and more preferably from about 6.25 to about 14.8 wt %. Suitable anionic surfactants include alkyl, alkylaryl or alkenyl sulfonates and alkyl and alkylene ethoxysulfates. Sodium dodecylbenzenesulfonate or tridecylbenzenesulfonate are particularly preferred anionic surfactants. Preferably, the inert diluent is present in the base bead formulation in an amount from about 35 to about 45 wt % and more preferably from about 36.69 to about 43.18 wt %. Suitable inert diluents comprise alkali metal chlorides, sulfates, nitrates and/or the like. For example, a preferred diluent comprises sodium chloride, sodium sulfate and/or mixtures thereof.

The base detergent also includes a copolymer, preferably having a molecular weight in the range of about 2,000 to about 5,000, more preferably between about 2,000 and about 3,000. Preferably, the copolymer is present in an amount of up to about 5 wt %, more preferably from about 0.59 to about 1.20 or 1.25 wt %. Preferably, the copolymer is comprised of an alkali metal salt of polyacrylic acid, polymethacrylic acid or a copolymer of acrylic and methacrylic acids, having a molecular weight in the range of about 2,000 to about 5,000, preferably about 2,000 to about 4,500, and more particularly about 2,000 to about 3,000. Preferably the polyacrylate has a pH in the range of about 5.0 to about 9.0, and more preferably about 5.0 to about 7.0. One particularly preferred polyacrylate comprises Polymer X-0125-BJ-76 available from Rhone-Poulenc of Cranbury, N.J.

The base detergent may include other conventional additives such as whitening agents, bleach and/or bleach alternatives, anti-caking agents and/or other similar adjuvants. Each of these adjuvants may be added in conventional amounts. For example, stilbene whitening agents are suitable for use within the context of the present invention. Such agents include the cyanuric chloride/diaminostilbene disulfonic acid (CC/DAS) type whiteners. For example, preferable whitening agents comprise TINOPAL® AMS-GX, available from CIBA-GEIGY Corporation of Greensboro, N.C., Blancophor DML SV2447 available from Mobay Chemical Corp. of Pittsburgh, Pa. and/or mixtures thereof.

Preferably, the agglomerated admix comprises a nonionic surfactant and a builder. Suitable nonionic surfactants include primary and secondary ethoxylated alcohols and the like. Preferably, such ethoxylates have about 2 to about 15 moles of ethylene oxide per mole of alcohol. Suitably the builder comprises an alkali metal carbonate, for example, sodium carbonate. Optional additives such as anti-caking agents and the like may also be incorporated into the admix in conventional amounts.

A particularly preferred detergent agglomerate includes between about 65 and about 85 wt %, preferably about 75 wt % of sodium carbonate, and between 13 and about 18 wt %, preferably about 15 wt % nonionic which evidences a bulk density of between about 730 and about 830 g/l.

In accordance with a preferred aspect of the present invention, the detergent agglomerate includes nonionic surfactants comprising a primary or secondary alcohol ethoxylate, such as a linear alcohol ethoxylate having a molecular weight in the range of 650 to 750, more preferably in the range of about 668 to about 703 and an EO content (weight percent) in the range of about 65 to about 75. Particularly preferred ethoxylates of this type include those of the general formula:

$$R—O—(CH_2CH_2O)_{12}—H$$

Where R is a blend of primary (linear) alcohols having between 12 and 16 carbons, preferably about 66% $C_{12}$, 27% $C_{14}$ and 6% $C_{12}$ alcohols. One such commercially available ethoxylate of this formula comprises SURFONIC® L24-12 surfactant available from Huntsman Corporation of Houston, Texas having a molecular weight of about 703 and an EO content (wt %) of about 71.9. (SURFONIC is a registered trademark of the Huntsman Corporation.) Other preferred ethoxylates include those of the general formula:

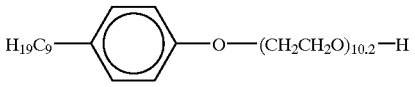

For example, ethoxylates generally referred to under the generic name Nonoxynol-10 typically fall within this category. A particularly preferred ethoxylate of this formula comprises SURFONIC® N-102 Surfactant also available from Huntsman Corporation of Houston, Tex. having a molecular weight of about 668 and an EO content (wt %) of about 67.1.

In accordance with one aspect of the present invention, all or a portion of the polymeric additive (i.e. the aforementioned copolymer) may also be contained in the agglomerate or blending formulation. In such cases, the copolymer may be present in amounts similar to those discussed hereinabove, for example, on the order of up to about 5.0 wt %, preferably in an amount from about 0.59 to 1.25 wt %.

In accordance with a preferred aspect of the present invention, the base granular composition is formed in a slurry which is spray-dried, and thereafter dry blended with the agglomerate, colorant, etc. to arrive at the final dry, particulate detergent. Preferably, a slurry comprising the base detergent ingredients is spray-dried and admixed with the agglomerate in a blending formulation which may also include anti-cake agents, whitening agents (e.g. fluorescent whitening agents), bleaching agents, alkalinity agents (e.g. alkali metal silicates), perfumes and/or colorants. Optional additional ingredients, such as foam control agents, processing aids, stain removal agents and other performance agents may also be utilized either in the blending formulation, the base detergent formulation or agglomerate as desired.

In accordance with a preferred aspect of the present invention the detergent formulation also includes an effective amount of a chlorine scavenger, preferably added to the blending formulation. It should be appreciated, however, that such additive may be included instead in the base bead formulation, the admix composition or both. Preferably, the scavenging additive comprises sodium percarbonate, sodium perborate or mixtures thereof. Other chlorine scavenging agents, such as sodium thiosulfate and the like may also be employed. Suitably, such additive is present in an amount which is effective to scavenge a predetermined amount of chlorine which may be present in the wash liquor, say for example on the order of about 0.5 to about 2.0 ppm. Preferably, such additive is present in an amount at least as great as the copolymer. For example, such a scavenger may be present in the blending formulation in an amount of about 0.59 to about 1.20 or 1.25 wt %. However, in certain applications, the amount may be increased such that in addition to serving a chlorine scavenging role, the reducing agent alone or in combination with other compositions may perform as a bleaching agent. In such cases, tone agent may be present in an amount on the order of 6.25 wt % or more.

Preferred blending formulations in accordance with various aspects of the present invention, with each of the components set forth in weight percent, are as follows:

| | Formulation 1 | Formulation 2 | Formulation 3 | Formulation 4 | Formulation 5 |
|---|---|---|---|---|---|
| Base bead | 55.16 | 88.61 | 96.44 | 85.14 | 97.42 |
| Agglomerated admix | 33.33 | 9.13 | 2.60 | 7.38 | 1.38 |
| Colorant composition | 0.11 | 0.00 | 0.00 | 0.24 | 0.24 |
| Sodium percarbonate | 10.50 | 0.00 | 0.00 | 0.00 | 0.59 |
| Sodium perborate | 0.00 | 1.25 | 0.59 | 6.25 | 0.00 |
| Inorganic filler | 0.90 | 0.50 | 0.00 | 0.50 | 0.50 |
| Perfume | 0.24 | 0.26 | 0.12 | 0.24 | 0.12 |

Preferably, the detergents in accordance with the present invention comprise low to moderate density, general, heavy-duty laundry detergent powders. In accordance with a preferred aspect of the present invention, the pour density of the finished product is preferably less than about 900 g/l, more preferably in the range of about 400 g/l. The detergents in accordance with the present invention have been found to be particularly well-suited for a broad range of applications, for example, ranging from gentle cleaning powder detergents to general heavy-duty laundry powder detergents.

Preferred final compositions (e.g. corresponding to Formulations 1–4, which are free of zeolite builders) in accordance with the present invention include the following components, all of which are listed in weight percent:

| | Formulation 1 | Formulation 2 | Formulation 3 | Formulation 4 | Formulation 5 |
|---|---|---|---|---|---|
| Sodium chloride/sulfate | 25.45 | 38.25 | 38.87 | 36.69 | 36.72 |
| Sodium carbonate | 4.47 | 30.65 | 38.49 | 29.45 | 39.66 |
| Sodium carbonate[1] | 25.00 | 6.85 | 2.21 | 5.54 | 1.04 |
| Sodium silicate | 3.04 | 3.99 | 10.51 | 3.83 | 12.66 |
| Sodium silicate[1] | 2.33 | 0.64 | 0.00 | 0.52 | 0.10 |
| Sodium dodecylbenzenesulfonate/ tridecylbenzenesulfonate | 18.00 | 13.20 | 6.00 | 12.68 | 6.00 |
| Primary alcohol ethoxylate[1] | 5.00 | 1.37 | 0.39 | 1.11 | 0.18 |
| Sodium polyacrylate | 2.00 | 1.25 | 0.59 | 1.20 | 0.59 |
| Fluorescent whitening agent | 0.70 | 0.26 | 0.11 | 0.25 | 0.25 |
| Sodium sulfate[2] | 0.70 | 0.12 | 0.81 | 0.18 | 0.12 |
| Water | 1.56 | 1.16 | 0.96 | 1.07 | 1.01 |
| Perfume | 0.24 | 0.26 | 0.12 | 0.24 | 0.12 |
| Sodium percarbonate | 10.50 | 0.00 | 0.00 | 0.00 | 1.25 |
| Sodium perborate | 0.00 | 1.25 | 0.59 | 6.25 | 0.00 |
| Colorant composition | 0.11 | 0.25 | 0.00 | 0.24 | 0.00 |
| Synthetic magnesium silicate | 0.90 | 0.50 | 0.00 | 0.50 | 0.50 |

[1]from the agglomerate
[2]from the slurry

It should be appreciated that while Formulations 1 to 5 are set forth in an illustrative manner herein, other detergent formulations having similar compositions or compositions generally between those of Formulations 1 to 5 are within the scope of the present invention.

For example, it should be appreciated that detergents in accordance with the present invention may include traditional heavy duty detergents, ultra (i.,e. concentrated) detergents, or either with bleach or bleach alternatives. In this regard Formulations A to C also exemplify various aspects of the present invention, with all amounts listed as weight percents.

| | A | B | C |
|---|---|---|---|
| Builder | 40.70 | 34.94 | 37.50 |
| Inert Diluent | 36.72 | 35.05 | 36.72 |
| Anticake agent | 12.76 | 6.51 | 6.88 |
| Anionic Surfactant | 6.00 | 12.70 | 13.20 |
| Nonionic Surfactant | 0.64 | 1.52 | 1.52 |
| Copolymer | 0.59 | 1.20 | 1.25 |
| Chlorine Scavenger | 0.59 | 6.25* | 1.25 |
| Bleach Alternative | 0.72 | 0.25* | 0.26 |

*In this example B, the bleaching function of the formulation is effected, in part, by the scavenger.

In accordance with various aspects of the present invention, and as described hereinabove, the detergent compositions according to the present invention preferably incorporate a polymeric component which aids in preventing redeposition of the dirty wash liquor on the items washed/cleaned with the detergent. Moreover, the detergent compositions also include an effective amount of a chlorine scavenger. The present inventors have found that detergents made in accordance with the present invention evidence improvements in inhibiting encrustation, redeposition and chlorine discoloration over repeated use. Stated another way, the detergents of the present invention enable good cleaning while significantly reducing the deposition of minerals and/or soil to maintain fabric softness and appearance.

To evidence the improved performance characteristics of the detergents according to the present invention, tests have been conducted to determine the presence of residues left on clothes washed with the detergents of the present invention, the softness of such articles after washing and the effect of such detergents on color retention of the articles washed. The following Examples reflect such tests.

EXAMPLE 1

Lack of Residues

Similarly sized, colored (navy blue) and content (100% cotton knit) pieces of fabric were washed in a conventional Tergotometer over five (5) cycles. In one case a wash liquor containing an amount of a conventional non-built, mixed active detergent without copolymer addition was used; in the other case an equal amount of a detergent of the composition set forth hereinabove in Formulation 1 was used. After washing over the five (5) cycles, the fabric samples were evaluated by a multi-member panel for residue on a scale of 0 to 5, with 0 being reflective of no residue, 1 being reflective of slight residue, 2 being reflective of low residue, 3 being reflective of moderate residue, 4 being reflective of heavy residue and 5 being reflective of very heavy residue. The samples were evaluated and the scores averaged. The samples washed with the conventional detergent were evaluated as exhibiting a heavy to very heavy residue (4.50) whereas the samples washed in a detergent in the form of Formulation 1 exhibited only low to moderate residue (2.50).

EXAMPLE 2

Enhanced Softness

The fabric samples used in Example 1 were also evaluated by the panel for softness by comparing the respective washed samples to unwashed fabric samples (i.e. a control) and evaluating them on a softness scale of 1 to 5 with 1 indicating that the test sample was much softer than the control, 2 indicating the test sample was slightly softer than the control, 3 indicating the test sample was equally as soft as the control, 4 indicating the test sample was slightly rougher than the control, and 5 indicating the test sample was much rougher than the control. The samples washed in the conventional detergent were evaluated as being slightly to much rougher than the control (4.20), whereas the samples washed in the detergent according to the present invention having a composition of that set forth above in Formulation 1 were about as soft as the control or slightly rougher (3.70).

EXAMPLE 3

Improved Color Retention

The fabric samples used in Example 1 were also evaluated by the panel for color retention. The panel compared the respective washed samples against a control unwashed fabric sample. As is generally known encrustation tends to make dark fabrics appear lighter due to the mineral build-up on the fabric, and thus the samples were evaluated on a darkness scale of 1 to 5, with 1 indicating that the sample was much darker than the control, 2 indicating slightly darker than the control, 3 indicating the same color as the control, 4 indicating slightly lighter than the control, and 5 indicating much lighter than the control. The samples washed in the conventional detergent were evaluated by the panel as being generally slightly lighter than the control (3.80), whereas the samples washed in the detergent according to the invention were generally about the same color as the control (3.10), thus evidencing superior color retention.

EXAMPLE 4

Improved Color Retention

Similarly sized, colored and content (100% cotton and 50/50 polyester/cotton blend fabrics) pieces of fabric were washed in a conventional washing machine over ten (10) wash cycles in a conventional non-built, mixed active detergent and a formulation of the composition set forth above as Formulation 2; after washing the samples were compiled into sets. Each set contained a test fabric washed in the inventive detergent, a test fabric washed in the conventional detergent and an unwashed fabric sample. These sets were evaluated by a multi-member panel, with each member comparing each of the two test fabrics to the unwashed (control) sample. The samples were rated on a scale of 1 to 10, with 1 being not similar to the control and 10 being identical to the control. Additionally, each panelist was asked to choose the test fabric visually most similar to the control.

The panel ratings were averaged and the results are as follows:

TABLE 1

| | Green[1] | Blue[1] | Black[1] | Red[2] | Blue[2] | Green[2] |
|---|---|---|---|---|---|---|
| Formulation 2 (avg) | 7.84 | 7.63 | 8.69 | 8.66 | 8.56 | 8.6 |
| Conventional (avg) | 2.58 | 3.5 | 4.03 | 7.6 | 5.69 | 4.0 |

[1]- 100% cotton
[2]- 50/50 poly-cotton blend

All of the test swatches for all of the colors and fabric types washed with the detergent Formulation 2 in accordance with the present invention were rated by the panelists as significantly more similar to the control (i.e. unwashed sample) than the swatches washed with the conventional detergent.

EXAMPLE 5

Improved Color Retention

The test of Example 4 was repeated using a detergent having the composition set forth above as Formulation 4 instead of Formulation 2. These samples were compared with the unwashed swatches and swatches washed under similar conditions with conventional detergents.

Again, all of the test swatches for all of the colors and fabric types washed with detergent in accordance with the present invention (e.g. Formulation 4) were rated by the panelists as significantly more similar in color to the control (e.g. unwashed sample) than the swatches washed with the conventional detergent.

Further, the panel rated the samples as follows:

TABLE 2

| | Burgundy[1] | Blue[1] | Green[1] | Burgundy[2] | Green[2] | Brown[2] |
|---|---|---|---|---|---|---|
| Formulation 4 (avg) | 7.75 | 7.28 | 8.21 | 8.78 | 7.50 | 8.84 |
| Conventional (avg) | 4.56 | 4.31 | 4.63 | 7.16 | 4.41 | 6.56 |

[1]- 100% cotton
[2]- 50/50 poly-cotton blend

EXAMPLE 6

Improved Color Retention

Fabric samples of various colors of 100% cotton and 50/50 poly-cotton blend materials were washed in over 20 wash cycles with, on one hand, detergent of the formulations set forth herein (namely Formulations 2 and 4) and on the other hand, a control conventional non-built, mixed active detergent. Colormetric readings from a color view spectrophotometer were taken at 0, 10, 15 and 20 cycles in conformance with ASTM D2244, E308 and 2244.

The data obtained was evaluated to determine the Total Color Difference namely ΔE, where $$\Delta E = \sqrt{(\Delta L)^2 + (\Delta a)^2 + (\Delta b)^2}$$

and L, a and b refer to the widely accepted tristimulus L, a, b scale coordinates, where L approximates the non-linear black-white response, and a and b identify the hue and chroma of the material on red-green and yellow-blue scales respectively. In accordance with such evaluations a high ΔE is reflective of high (i.e. significant) color change.

The results of these tests are illustrated in Tables 3–6 below:

TABLE 3

| | Control Wash/Dry Cycles | | | Formulation 2 Wash/Dry Cycles | | |
|---|---|---|---|---|---|---|
| Fabric 100% Cotton | 10 ΔE | 15 ΔE | 20 ΔE | 10 ΔE | 15 ΔE | 20 ΔE |
| Black A | 1.89 | 4.12 | 6.30 | 0.63 | 0.94 | 1.59 |
| Black B | 0.97 | 3.17 | 5.04 | 0.61 | 1.09 | 1.71 |
| Green A | 5.11 | 7.95 | 9.77 | 1.01 | 2.15 | 3.05 |
| Green B | 4.28 | 7.16 | 9.05 | 1.13 | 2.09 | 2.55 |
| Blue A | 3.87 | 6.00 | 8.46 | 0.79 | 1.34 | 2.43 |
| Blue B | 3.79 | 6.78 | 8.41 | 0.47 | 1.38 | 2.01 |

TABLE 4

| Fabric | Control Wash/Dry Cycles | | | Formulation 2 Wash/Dry Cycles | | |
|---|---|---|---|---|---|---|
| 50/50 poly/cotton | 10 ΔE | 15 ΔE | 20 ΔE | 10 ΔE | 15 ΔE | 20 ΔE |
| Royal Blue | 1.44 | 1.96 | 2.82 | 0.79 | 1.06 | 1.47 |
| Brown | 1.32 | 2.55 | 3.41 | 0.67 | 0.84 | 1.60 |
| Burgundy | 1.75 | 2.72 | 3.19 | 0.92 | 1.43 | 1.98 |

TABLE 5

| Fabric | Control Wash/Dry Cycles | | | Formulation 4 Wash/Dry Cycles | | |
|---|---|---|---|---|---|---|
| 50/50 poly/cotton | 10 ΔE | 15 ΔE | 20 ΔE | 10 ΔE | 15 ΔE | 20 ΔE |
| Brown A | 1.00 | 2.10 | 2.98 | 0.43 | 0.58 | 1.33 |
| Brown B | 1.20 | 2.00 | 2.88 | 0.43 | 1.00 | 1.55 |
| Green A | 1.36 | 3.74 | 5.56 | 0.46 | 0.98 | 2.33 |
| Green B | 1.70 | 3.73 | 5.74 | 0.39 | 0.86 | 2.17 |
| Maroon A | 0.93 | 1.56 | 2.37 | 0.39 | 0.60 | 1.15 |
| Maroon B | 0.59 | 1.45 | 2.39 | 0.61 | 0.62 | 1.38 |

TABLE 6

| | Control Wash/Dry Cycles | | | Formulation 2 Wash/Dry Cycles | | |
|---|---|---|---|---|---|---|
| Fabric 100% Cotton | 10 ΔE | 15 ΔE | 20 ΔE | 10 ΔE | 15 ΔE | 20 ΔE |
| Black A | 1.98 | 3.55 | 5.34 | 0.68 | 1.13 | 2.76 |
| Black B | 1.66 | 3.23 | 4.85 | 0.65 | 1.32 | 2.54 |
| Blue A | 1.88 | 3.52 | 5.25 | 0.27 | 1.02 | 2.64 |
| Blue B | 1.40 | 3.23 | 5.44 | 0.20 | 1.29 | 3.01 |
| Green A | 2.25 | 3.90 | 4.62 | 0.97 | 1.39 | 2.58 |
| Green B | 2.18 | 3.80 | 5.06 | 0.85 | 1.33 | 2.38 |
| Maroon A | 1.82 | 3.09 | 4.53 | 1.62 | 1.81 | 2.87 |
| Maroon B | 2.02 | 3.50 | 4.76 | 1.14 | 1.69 | 2.95 |

As should now be appreciated, the detergents in accordance with the present invention evidence improved color retention and other properties. Such detergents are particularly suited for use in a wide variety of cleaning applications.

It will be understood that the foregoing description is of preferred exemplary embodiments of the present invention, and that the present invention is not limited to the specific examples and compositions set forth herein. Such examples and compositions are for illustrative purposes only. Various modifications may be made in light thereof as will be suggested to persons skilled in the art without departing from the scope of the invention as expressed in the appended claims.

We claim:

1. A laundry detergent composition having improved anti-redeposition properties comprising:

about 55 to about 97 wt % of a spray dried slurry of an alkali metal carbonate built base detergent composition including about 30 to about 50 wt % alkali metal carbonate and a sodium polyacrylate having a molecular weight in the range of about 2,000 to about 5,000; and, about 1 to about 33 wt % of an agglomerated admix formulation including between about 65 and about 85 wt % of an alkali metal carbonate and a nonionic surfactant; and, about 0 to about 5 wt % of an additive.

2. The laundry detergent composition of claim 2 wherein the sodium polyacrylate comprises about 0.59 to about 5 wt % of the alkali metal carbonate built base detergent composition, and wherein the sodium polyacrylate is a sodium salt of polyacrylic acid, polymethacrylic acid or a copolymer thereof.

3. The laundry detergent composition of claim 2 wherein the sodium polyacrylate is present in an amount of about 0.59 to about 1.25 wt. % of the base detergent composition.

4. The laundry detergent composition of claim 3 wherein the sodium polyacrylate has a molecular weight in the range of 2000 to 4500.

5. The laundry detergent composition of claim 4 wherein the sodium polyacrylate has a pH ranging from about 5 to about 9.

6. The laundry detergent composition of claim 2 wherein the alkali metal carbonate is sodium carbonate, and wherein the alkali metal carbonate base detergent further includes an anionic surfactant and an inert diluent.

7. The laundry detergent composition of claim 6 wherein the anionic surfartant is an alkyl sulfonate, an alkylaryl sulfonate, an alkenyl sulfonate, an alkyl ethoxysulfates or an alkylene ethoxysulfate.

8. The laundry detergent composition of claim 7 wherein the anionic surfactant is the alkyl sulfonate comprising about 6–15 wt % of the base detergent composition.

9. The laundry detergent composition of claim 8 wherein the alkyl sulfonate is dodecylbenzenesulfonate, tridecylbenzenesulfonate or a combination thereof.

10. The laundry detergent composition of claim 7 wherein the inert diluent includes an alkali metal chloride, sulfate, nitrate or combination thereof.

11. The laundry detergent composition of claim 2 wherein the nonionic surfactant includes primary or secondary ethoxylated alcohols having 2–15 moles of ethylene oxide per mole of alcohol.

12. The laundry detergent composition of claim 2 wherein the nonionic surfactant is a linear alcohol ethoxylate having a molecular weight of about 650–750.

13. The laundry detergent composition of claim 2 further comprising 0.59–6.25 wt % of a chlorine scavenger in the base detergent.

14. The laundry detergent composition of claim 13 wherein the chlorine scavenger is sodium perborate.

15. A method of preparing a laundry detergent composition to prevent redeposition and encrustation comprising the steps of:

spray drying a base slurry detergent composition including a sodium polyacrylate having a molecular weight in the range of about 2,000 to about 5,000 and about 30 to about 50 wt % alkali metal carbonate;

providing an agglomerated admix formulation including nonionic surfactant, between about 65 and about 85 wt % of alkali metal carbonate builders; and, mixing about 55 to about 97 wt % of the base detergent composition with about 1 to about 33 wt % of the agglomerated admix formulation and about 0 to about 5 wt % of an additive to produce a granular detergent composition.

16. The method of claim 15 further comprising adding a chlorine scavenger to the detergent composition.

17. The method of claim 16 wherein the step of adding the chlorine scavenger comprises providing on the order of about 0.59 to about 6.25 wt. % of sodium percarbonate, sodium perborate or mixtures thereof to the detergent composition.

* * * * *